United States Patent [19]

Kasahara et al.

[11] Patent Number: 4,928,144

[45] Date of Patent: May 22, 1990

[54] DEVELOPING DEVICE FOR A COLOR IMAGE FORMING APPARATUS

[76] Inventors: Nobuo Kasahara, 80-46, Nakazawa-cho, Asahi-ku, Yokohama-shi, Kanagawa-ken; Susumu Wagi, Kikuchi Dai-1 Mansion, 4-12-13, Tokumaru, Itabashi-ku, Tokyo, both of Japan

[21] Appl. No.: 185,693

[22] Filed: Apr. 22, 1988

[30] Foreign Application Priority Data

May 31, 1987 [JP] Japan ..... 62-136035
May 31, 1987 [JP] Japan ..... 62-136036

[51] Int. Cl.[5] ..... G03G 15/06; G03G 15/01
[52] U.S. Cl. ..... 355/245; 355/326
[58] Field of Search ..... 355/3 R, 3 DD, 14 D, 355/4; 118/656-658

[56] References Cited

U.S. PATENT DOCUMENTS

| | | | |
|---|---|---|---|
| 3,970,042 | 7/1976 | Rees | 355/4 X |
| 3,987,756 | 10/1976 | Katayama et al. | 355/4 X |
| 4,072,412 | 2/1978 | Suda et al. | 355/4 X |
| 4,792,225 | 12/1988 | Itaya | 118/657 X |
| 4,816,870 | 3/1989 | Nagayama | 355/3 DD |

*Primary Examiner*—A. T. Grimley
*Assistant Examiner*—E. Pipala

[57] ABSTRACT

A developing device applicable to a color image forming apparatus includes a color developing unit and a black developing unit which are arranged around an image carrier of the apparatus. The color developing unit has at least two color developing sections and is constructed and arranged independently of the black developing unit. The end walls of at least two of the color developing sections of the color developing unit are constituted by common support members. This kind of developing device is efficient in view of the fact that the black developing unit is used more frequently than the color developing unit.

15 Claims, 8 Drawing Sheets

DEVELOPING DEVICE FOR A COLOR IMAGE FORMING APPARATUS

FIELD OF THE INVENTION

The present invention relates to a developing device applicable to a color image forming apparatus and including a plurality of color developing units and a single developing unit for development in black, the developing units being arranged around an image carrier of the apparatus.

BACKGROUND OF THE INVENTION

The above described type of developing device is well known in the art in relation to a family of color image forming apparatuses typical of which are a color copier and a color printer. The developing device includes a plurality of developing units which are selectively operated to develop an electrostatic latent image provided on an image carrier in particular colors. The developing units are independent of each other and disposed around the image carrier. This increases the total number of structural elements of the device, resulting in the structure being complicated and the cost being increased. Further, since the developing units are mounted one by one to the housing of an image forming apparatus, high positional accuracy is not achievable without resorting to a complicated arrangement. In addition, adjustment involved in the inspection and maintenance of the individual units is troublesome.

All the developing units stated above may be constructed into a unitary assembly to promote common use of various structural elements of the different units and thereby to eliminate the above-discussed shortcomings. Such a scheme, however, brings about another problem, as will be described hereinafter.

A color copier, a color printer, or like color image forming apparatus usually has a capability of producing black-and-white copies by the black developing unit only as an ordinary black-and-white copier, in addition to a capability of producing color copies. Generally, this type of image forming apparatus is used more frequently for producing black-and-white copies than for producing color copies which may or may not include black. It follows that the rate of toner consumption in the black developing unit is higher than those in the other or color developing units. Further, when a developer is implemented as a two-component developer, the developer stored in the black developing unit becomes degraded earlier than those stored in the other developing units. For these reasons, the black developing unit usually needs maintenance more frequently than the color developing units.

In the above situation, if all of the color and black developing units are unseparably assembled together, the whole assembly has to be pulled out of the housing of the image forming apparatus when only one of them needs inspection, repair, or the like. Especially, when the black developing unit which is used more frequently than the color developing units needs some maintenance work, it is necessary to pull out the color developing units, which are still operable, along with the black unit. The result is troublesome and even wasteful manipulation.

As stated above, the independent developing unit scheme brings about a complicated structure and other various problems, while the unseparable assembly scheme obstructs easy and efficient maintenance.

OBJECTS OF THE INVENTION

It is therefore an object of the present invention to provide a developing device applicable to a color copier or like color image forming apparatus which includes a plurality of color developing units and a single black developing unit, which device promotes easy and efficient maintenance while avoiding intricacy of construction.

It is another object of the present invention to provide a generally improved developing device for a color image forming apparatus of the type described.

SUMMARY OF THE INVENTION

A device according to the invention is intended to be installed in an image forming apparatus having an image carrier. The device comprises first developing means comprising a plurality of developing sections which are arranged around the image carrier, at least two of the developing sections being-constructed into a single unit, and second developing means comprising a single developing unit disposed around the image carrier. The unit of the first developing means and the unit of the second developing means are constructed and arranged independently of each other.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
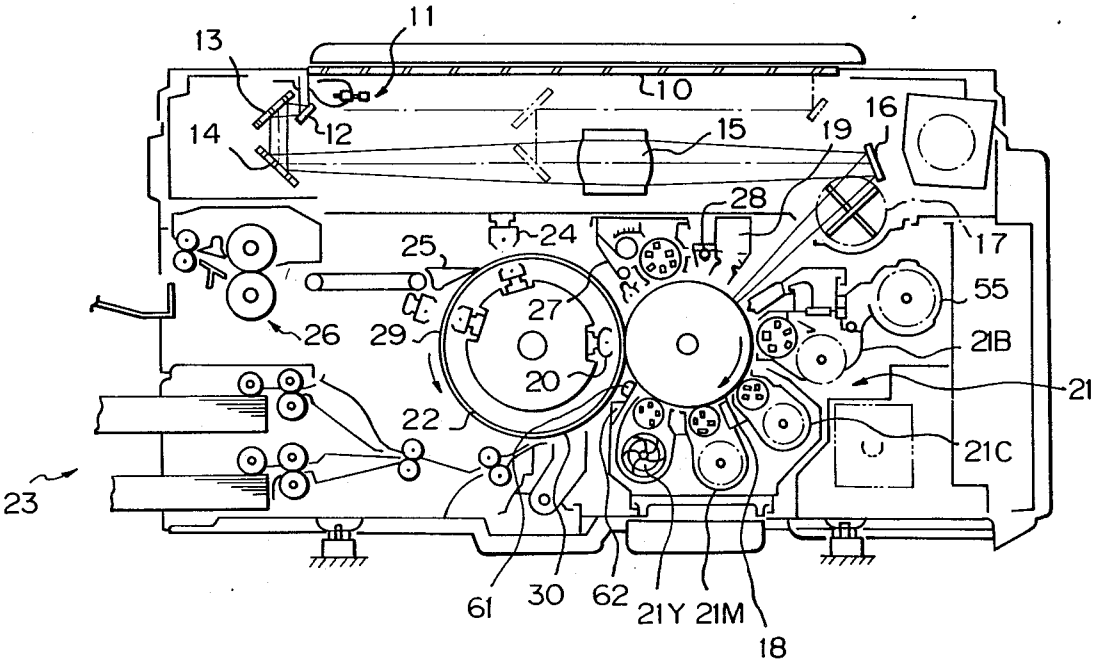
FIG. 1 is a section showing a color copier to which a developing device in accordance with the present invention is applied.

Referring to FIG. 1 of the drawings, a color copier to which the present invention is applied is shown. To better understand the present invention, a general construction of the copier will be described first.

In FIG. 1, an illuminating unit 11 is movable together with a first mirror 12 to the right as viewed in the figure to sequentially scan an original document, not shown, which is laid on a glass platen 10. The resulting image-wise light is incident to a lens 15 by way of a second mirror 13 and a third mirror 14 which are moved in the same direction as the illuminating unit 11. The lens 15 focuses the imagewise light onto a photoconductive drum, or image carrier, 18 via a fourth mirror 16 and a filter assembly 17, the photoconductive drum 16 being rotated clockwise as viewed in the figure. The filter assembly 17 includes a plurality of color separating filters, as is well known in the art. A blue component of the imagewise light, for example, is separated first by one of the filters of the filter assembly 17 and focused on the photoconductive drum 18, which has been uniformly charged by a charger 19. As a result, a latent image is electrostatically formed on the photoconductive drum 18.

A developing device 21 embodying the present invention is disposed below the photoconductive drum 18 and made up of a yellow developing section 21Y, a magenta developing section 21M, a cyan developing section 21C, and a black developing unit 21B. The distinction between the words "unit" and "section" will become apparent from the description to follow. The latent image mentioned above is developed by, for example, the yellow developing section 21Y first.

A paper 29 having a leading end **29*a* fed from a paper feed section 23 is wrapped around a transfer drum 22 and held thereon with its leading end 29*a* retained by a clamp 30. The toner image provided on the photoconductive drum 18 by the yellow developing section 21Y is transferred to the paper 29 by a transfer charger 20. A magenta toner image and a cyan toner image provided on the photoconductive drum 18 in the same manner as the yellow toner image are sequentially transferred one upon the other to the paper 29, with or without a black toner image produced by the black developing unit 21B being superposed on those toner color toner images. For the exposure of the photoconductive drum 18 to black imagewise light, use may or may not be used of an ND filter. After the transfer of such toner images, the paper 29 is separated from the transfer drum 22 by a separator charger 24 and a separator pawl 25 and then driven out of the copier by way of a fixing unit 26. The toner remaining on the photoconductive drum 18 is removed by a cleaning unit 27, and then the photoconductive drum 18 is discharged by a lamp 28**.

The copier is capable of producing a black-and-white copy in addition to the full-color copy as described above. For a black-and-white copy mode, a mode selection key or the like, not shown, is operated to actuate the black developing unit 21B with the color developing sections 21Y, 21M and 21C held inoperative. Usually, the black-and-white copy mode is used more frequently than the color copy mode.

Figure 4:
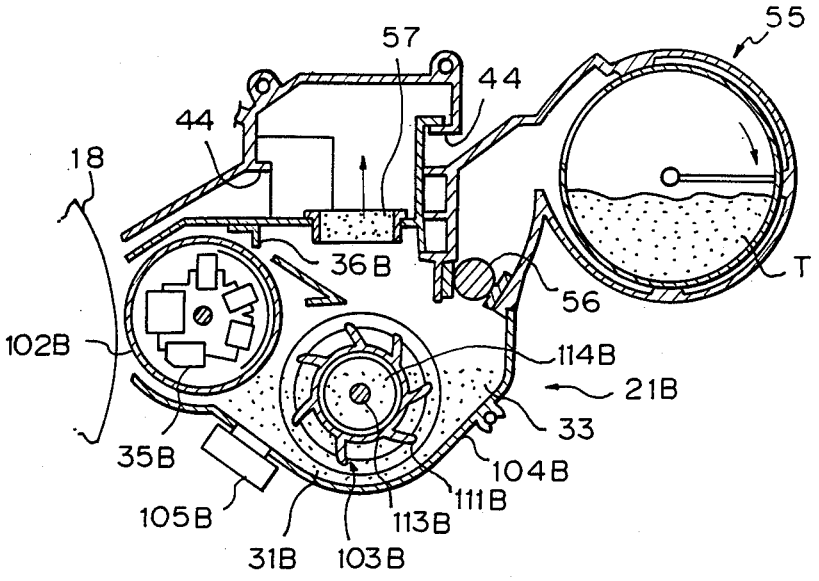
FIG. 4 is a section of a black developing unit.

As shown in FIG. 1, the black developing unit 21B and the color developing sections 21M, 21C and 21Y are arranged one after another around the photoconductive drum 18. The color developing sections 21Y, 21M and 21C are individually adapted to produce color images and will hereinafter be collectively referred to as a color developing unit as distinguished from the black developing unit 21B. Specifically, as shown in FIGS. 1, 2 and 4, the color developing sections 21Y, 21M and 21C are constructed into a unit together, and that unit is provided independently of the black developing unit 21B.

Figure 2:
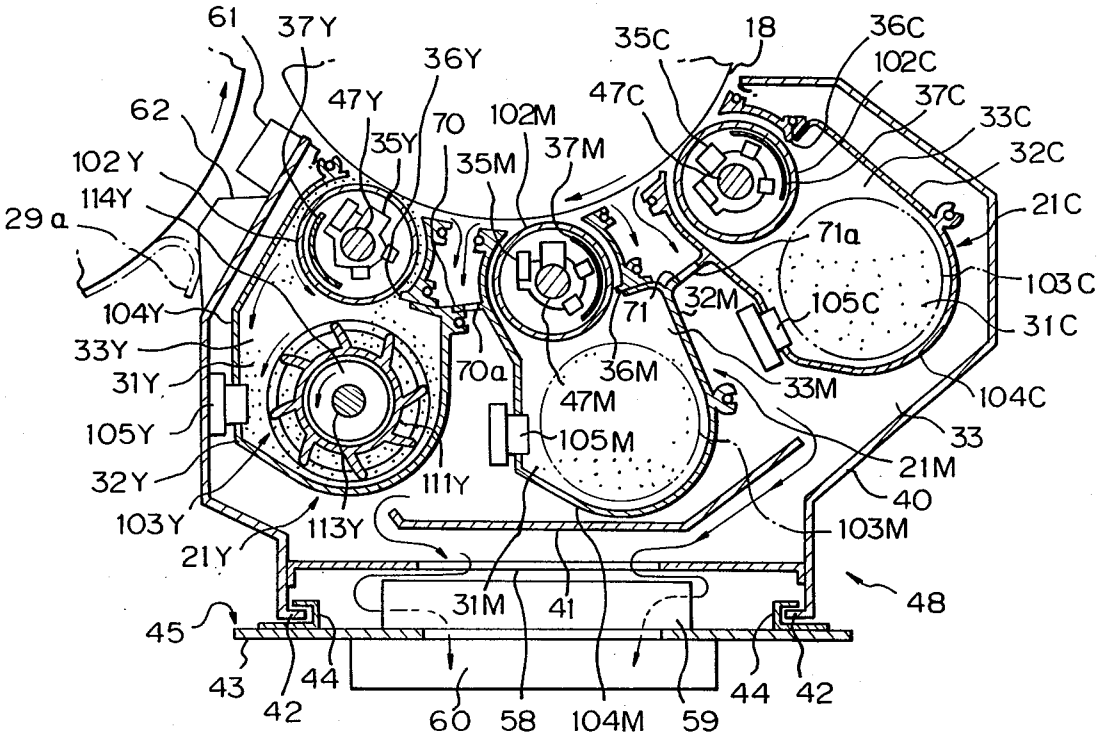
FIG. 2 is a partly simplified and partly omitted section of a color developing unit which is installed in the device of FIG. 1 and includes a plurality of color developing sections.

Referring to FIG. 2, the color developing sections 21Y, 21M and 21C are shown in detail. Since all the color developing sections 21Y, 21M and 21C are essentially identical in structure, the following description will concentrate on the yellow developing section 21Y by way of example. The yellow developing section 21Y includes a casing 104Y in which a two-component yellow developer 31Y is stored. Defining a developer storing section, the casing 104Y is made up of a body 32Y, an end wall 33Y rigidly connected to the front end of the body 32 as viewed in FIGS. 1 and 2, and an end wall 34Y (see FIG. 8) connected to the rear end as viewed in the same figures. The word "front" as distinguished from "rear" should be understood to be representative of the side where an operator usually stands to operate the copier. A developing roller, or developer carrier, 102Y is located in an upper portion of the casing 104Y and is rotatably supported by the opposite end walls 33Y and 34Y. Accommodated in the developing roller 102Y is a magnet 35Y. The magnet 35Y is rigidly mounted on a shaft 47Y which is in turn supported by the end walls 33Y and 34Y. An agitating member 103Y is positioned below the developing roller 102Y, while an inner screw 114Y is disposed in the agitating member 103Y. The agitating member 103Y and a shaft 113Y of the inner screw 114Y are also rotatably supported by the end walls 33Y and 34Y at opposite ends thereof.

Assume that a latent image formed on the photoconductive drum 18 is developed by the yellow developing section 21Y, as previously stated. The yellow developer 31Y is supplied to the developing roller 102Y by the agitating member 103Y, which is rotated clockwise. The developer 31Y is transported toward the photoconductive drum 18 by the developing roller 102Y, which is rotated counterclockwise. As a result, the latent image on the photoconductive drum 18 is developed by the yellow developer 31Y to become a yellow toner image. In the illustrative embodiment, the two-component developer is made up of carrier and toner and at least partly constituted by a magnetic material. Hence, the developer on the developing roller 102Y is retained on the surface of the developing roller 102Y by the force of the magnet 35Y while being transported by the developing roller 102Y. A doctor blade 36Y is fixed to the opposite end walls 33Y and 34Y so as to regulate the amount of developer to be transported by the developing roller 102Y. A toner sensor 105Y responsive to the varying density of toner is rigidly mounted on the body 32Y.

The structural elements of the magenta developing section 21M and those of the cyan developing section 21C are arranged in essentially the same manner as those of the yellow developing section 21Y and, therefore, they are denoted by the same reference numerals except for the substitution of suffixes M and C for Y. To avoid the intricacy of illustration, the agitating members 103M and 103C are simply represented by phantom lines with screws and other elements associated therewith omitted.

The magenta and cyan developing sections 21M and 21C, respectively, include casings 104M and 104C, respectively. A two-component magenta developer 31M is stored in the casing 104M, and a two-component cyan developer 31C in the casing 104C. Each of the developing sections 21M and 21C, like the developing section 21Y, develops a latent image provided on the photoconductive drum 18 in its own color. The sections 21Y, 21M and 21C alternately develop a latent image on the photoconductive drum 18 with or without the black unit 21B (FIG. 1) joining them. Hence, while one of them is developing a toner image, the others are held inoperative. In this particular embodiment, magnetic plates 37Y, 37M and 37C are respectively disposed in the developing rollers 102Y, 102M and 102C as means for enabling the developing sections 21Y, 21M and 21C one at a time. Specifically, while one of the developing sections 21Y, 21M and 21C is operating, its associated magnetic plate as represented by the plate 37Y in FIG. 2 is located remote from the doctor blade 36Y so that the developer 31Y may be supplied to and transported by the developing roller 102Y. In this condition, the other or inoperative section (i.e., sections 21M and 21C in FIG. 2) have their magnetic plates 37M and 37C located to face their associated doctor blades 36M and 36C, preventing the developers 31M and 31C from being transported by the developing rollers 102M and 102C toward the photoconductive drum 18. This is also true with the black developing unit 21B.

Details of the color developing unit which is made up of the three sections 21Y, 21M and 21C will be described. In the embodiment of FIG. 2, the casing bodies 32Y and 32M of the developing sections 21Y and 21M are interconnected by a rib 70, while the casing bodies 32M and 32C of the developing sections 21M and 21C are interconnected by a rib 71. That is, the three casing bodies 32Y, 32M and 32C are constituted by a single unitary part and not by independent parts and, therefore, the three sections 21Y, 21M and 21C are constructed into a unit. Also, the rear end walls 33Y, 33M and 33C are constituted by a single support member 33 and not by independent members, and the front end walls 34Y, 34M and 34C are constituted by a single support member 34 (FIG. 8) and not by independent members. The casing bodies 32Y, 32M and 32C are interconnected to each other and are rigidly connected to the support members 33 and 34 at opposite ends thereof by screws, welding or like technology. That is, the developing sections 21Y, 21M and 21C are joined together not only by the ribs 70 and 71 but also by the support members 33 and 34.

The structural elements 102Y, 103Y, 113Y, 35Y, 36Y and the like which are mounted to the end walls 33Y and 34Y as previously stated are supported by the common support members 33 and 34. This applies to the other color developing sections 21M and 21C also. Hence, the support members 33 and 34 serve as support means for supporting the various structural elements including the three casing bodies 32Y, 32M and 32C. Stated another way, the casing members 32Y, 32M and 32C play the role of a structural body which interconnects the support members 33 and 34 to guarantee the rigidity of the three sections, i.e. they play the role of a stay.

Figure 3:
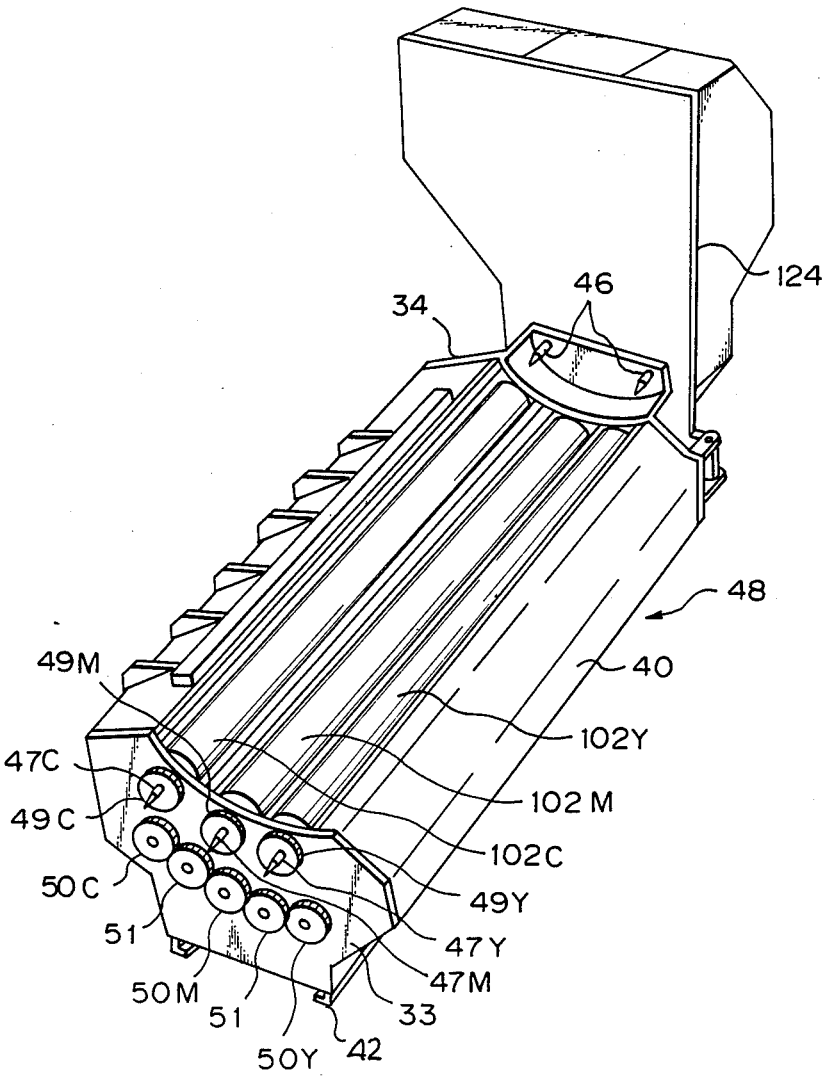
FIG. 3 is perspective view of the unit of FIG. 2 as viewed from the opposite side to the sheet surface of FIG. 2.

As shown in FIG. 3, gears 49Y, 49M and 49C are located at the rear of the rear support member 33 and are respectively fixed to the developing rollers 102Y, 102M and 102C which are in turn rotatably supported by the common support members 33 and 34. Likewise, gears 50Y, 50M and 50C are located at the rear of the rear support member 33 and individually fixed to the shaft 113Y of the agitating member 103Y of the yellow developing section 21Y and those of the other color developing sections, as is also shown in FIG. 3. The gears 50Y, 50M and 50C are held in mesh through idle gears 51. A drive gear, not shown, is provided on the copier body for driving the gears 49Y, 49M and 49C and the gears 50Y, 50M and 50C.

While the casing bodies 32Y, 32M and 32C may be constituted by independent members and individually fixed to the support members 33 and 34, interconnecting them beforehand by the ribs 70 and 71 into a single part as shown in FIGS. 1 and 2 is more advantageous in facilitating production and positioning.

As shown in FIG. 3, a cover 40 is provided to enclose the color developing sections 21Y, 21M and 21C and is rigidly connected at opposite ends thereof to the support members 33 and 34. The cover 40 and a flow regulator plate 41 (shown in FIG. 2) which will be described constitute a color developing unit 48 together with the other structural elements. Slide portions 42 are formed in a lower part of the cover 40 and are individually mated with guide rails 44, which are in turn mounted on a frame 43 of a copier body 45, so that the color developing unit 48 may be pulled out forward toward the operator.

As stated above, the color developing sections 21Y, 21M and 21C are joined with each other and, in the illustrative embodiment, constitute the color developing unit 48 together with the cover 40 and other elements. On the other hand, the black developing unit 21B is constructed and arranged independently of the unit 48. As shown in FIG. 4, the black developing unit 21B has essentially the same construction as an ordinary developing device and, therefore, various parts of the unit 21B are designated by the same reference numerals as those of the yellow developing section 21Y of FIG. 2 except for the substitution of the suffix B for the Y. What distinguishes the black developing unit 21B from the yellow developing section 21Y are as follows: a toner supply roller 56 is rotated when the toner density of the developer 31B stored in the developer casing 104 is lowered so as to supply toner T from a toner supply section 55, an air filter 57 is provided in an upper portion of the casing 104B so that air may be let out therethrough to prevent the toner T from being scattered around, and the casing 104B is provided with an exclusive rear end wall 33B and an exclusive front end wall, not shown. This unit 21B, too, is supported in such a manner as to be movable along guide rails 44. The operation of the black developing unit 21B is the same as that of the color developing sections 21Y, 21M and 21C except for the use of a black developer.

The color developing unit 48 and the black developing unit 21B are independent of each other as stated and therefore can be pulled out independently of each other as needed. Specifically, when it is desired to work any of the color developing sections 21Y, 21M and 21C for inspection, repair or the like, the color developing unit 48 is bodily pulled forward out of the copier body along the guide rails 44. After the work, the color developing unit 48 is pushed into the copier body until it reaches a predetermined position. As shown in FIG. 3, positioning pins 46 extend rearward from the front support member 34 which serves as the front end walls 33Y, 33M and 33C. The support shafts 47Y, 47M and 47C associated with the magnets 35Y, 35M and 35C, respectively, extend rearward from the rear support member 33 and are located at the center of their associated developing rollers 102Y, 102M and 102C. The support shafts 47Y, 47M and 47C bifunction as positioning pins.

While the color developing unit 48 is held in a predetermined position within the copier body, the positioning pins 46 and the support shafts 47Y, 47M and 47C are individually mated with holes which are formed through a front and a rear frame of the copier body. In this condition, the developing sections 21Y, 21M and 21C, especially their developing rollers, are individually located at their predetermined positions relative to the photoconductive drum 18. The other structural elements are also joined with the unit 48 in such a relative position that they are capable of performing predetermined functions. Hence, when the color developing unit 48 is positioned relative to the copier body 45, all the structural elements are successfully positioned relative to each other and to the copier body 45.

As the color developing unit 48 is pulled out, the pins 46 and the support shafts 47Y, 47M and 47C are moved out of their associated positioning holes while, at the same time, the gears 49Y, 49M and 49C and the gears 50Y, 50M and 50C are brought out of mesh with the gears which are provided on the copier body 45. Thereafter, the color developing unit 48 is pushed into the copier until the pins 46 and the support shafts 47Y, 47M and 47C mate with their associated positioning holes and the various gears mesh with their counterparts.

To work on the black developing unit 21B, all that is required is pulling it out along the guide rails 44. Although not shown, the unit black developing 21B is also provided with positioning pins to be accurately located in a predetermined position when loaded in the copier.

Various advantages are attainable, with the above construction in which the color developing unit 48 and the black developing unit 21B are workable independently of each other. Generally, a black developing unit is used more frequently and therefore requires maintenance more frequently than a color developing unit. Since the color developing sections 21Y, 21M and 21C and the black developing unit 21B are provided independently of each other, only the black unit 21B can be worked on as desired with the color sections 21Y, 21M and 21C untouched.

Further, the developing device shown and described is open to various user-oriented design modifications. Specifically, the size of the black developing unit 21B may be increased relative to the size of the color developing unit 48 for a copier of the kind which is rarely used to produce color copies or, alternatively, the sizes of the color developing sections 21Y, 21M and 21C may be decreased. This is successful in allowing the individual developing units to be worked on at adequate maintenance intervals to enhance cost performance and in reducing the overall dimensions of a copier with ease.

On the other hand, the color developing sections 21Y, 21M and 21C are joined together and, in the illustrative embodiment, constructed into the color developing unit 48 together with the other structural elements. This simplifies maintenance work, reduces the number of parts, and cuts down the cost compared to the case wherein they are constructed independently of each other. Specifically, since the three casing bodies 32Y, 32M and 32C are implemented as a single part and their end walls are constituted by the common support members 33 and 34, the number of parts is reduced, and, in the event of production of a copier of a developing device, the various parts are positioned with accuracy relative to each other to increase productivity. In addition, the developing device can be easily transported before it is mounted in a copier. Since the casing bodies 32Y, 32M and 32C which are integral with each other, they can be produced far more easily than independent casing bodies. Further, the color developing sections 21Y, 21M and 21C can share common development switching means and common scattered toner collecting means.

The casing bodies 32Y, 32M and 32C which are implemented as a single part and the support members 33 and 34 may be produced as separate parts and connected to each other by screws, welding or like technology. Alternatively, they may be implemented with a single molding of aluminum or like metal, synthetic resin, or the like. Another possible approach is molding the three casing bodies together by using aluminum or the like and putting it in a mold which is to be used to produce the support members 33 and 34 by using synthetic resin.

While all the color developing sections 21Y, 21M and 21C have been described as being joined together, the above-stated advantages are attainable even by joining only two of them to each other. In the illustrative embodiment, the black developing unit 21B is separated from the color developing sections 21Y, 21H and 21C, but the front and rear end walls of the unit 21B and sections 21Y, 21H and 21C may be constituted by common support members. Alternatively, two or more of such a unit and sections may be combined such that their end pieces serve as common support members. The present invention is applicable to any type of developing unit insofar as it has more than two developing units. The gist is that the end walls of at least two developing units are individually constituted by common support members, and that the casing bodies of the developing units are integrally connected to the support members. While the unitary construction of the casing bodies has been implemented by both ribs and support members which are located at opposite ends of the ribs, the ribs or the support members may be omitted.

The cover 40 shown in FIG. 2 plays the role of an air guide member in addition to the role of a protective cover for protecting the color developing sections 21Y, 21M and 21C. The function of the cover 40 as an air guide member will be described for reference. When the color developing unit 48 is loaded in the copier body, a vent 58 formed through the bottom of the cover 40 is brought into alignment with a filter 59 in the copier body. As a blower 60 disposed below the filter 59 draws air inwardly, toner scattering around from top openings of the developer casings is collected. At this instant, the cover 40 serves to guide the stream of air as indicated by an arrow in FIG. 2. To further enhance efficient collection of toner, the ribs 70 and 71 may be respectively formed with openings **70*a* and 71*a* for passing air therethrough. The previously mentioned flow regulator plate 41 functions to regulate air which has flown through the clearance between the nearby developing sections, whereby air is distributed throughout the interior of the cover 40. The flow regulator plate 41 is rigidly connected to the bottom of the cover 40 or to the support members 33 and 34**.

Figure 5:
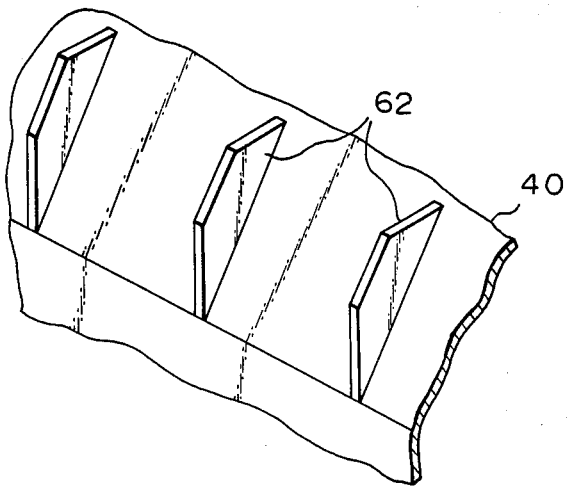
FIG. 5 is a perspective view of guide fins.

A toner image provided on the photoconductive drum 18 is transferred to a paper 29, as stated earlier. Before such image transfer, a pretransfer lamp 61 shown in FIGS. 1 and 2 is turned on to illuminate the photoconductive drum 18 to thereby facilitate the transfer of a toner image from the photoconductive drum 18. That part of the cover 40 which neighbors the pretransfer lamp 61 is provided with a number of guide fins 62, as shown in FIGS. 1 and 2 and as best seen in FIG. 5. The effect attainable with the guide fins 62 will also be described for reference. Assuming that the leading end **29*a* of the paper 29 wrapped around the transfer drum 22 has been released by accident from the clamp 30, it becomes free and is apt to deform toward the photoconductive drum 18. Should the leading end 29*a* of the paper 29 make contact with the surface of the photoconductive drum 18, the former might scratch the latter. In such a condition, the guide fins 62 serve to guide the free leading end 29***a* of the paper 29 as represented by a phantom line in FIG. 2 and thereby to prevent it from being brought into contact with the photoconductive drum 18.

Advantageous constructions for agitating a developer in any of the developer casings, supplying a supplementary amount of toner, and replacing the developer will be discussed in relation to the present invention. Again, the following description will concentrate on the yellow developing section 21Y by way of example.

Figure 6:
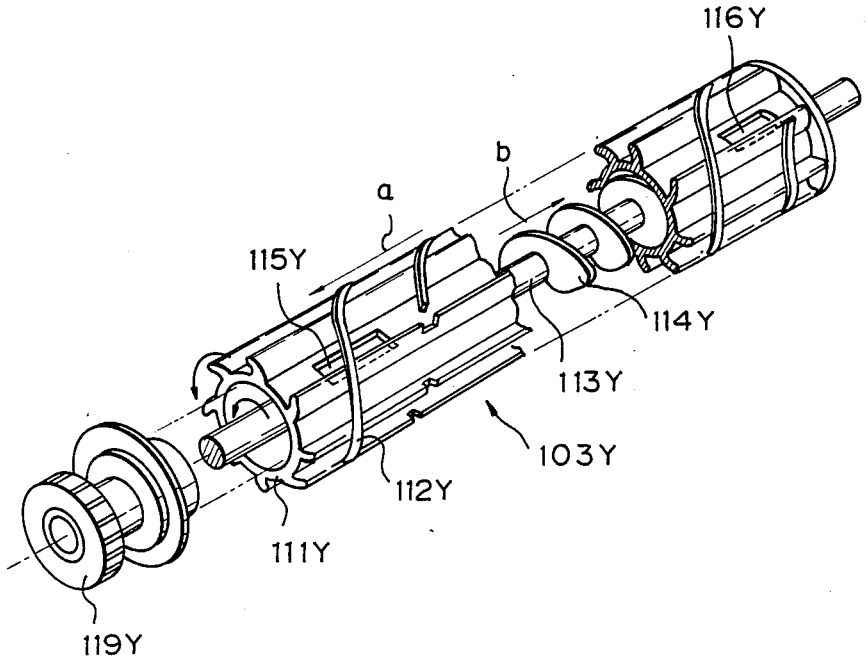
FIG. 6 is a perspective view of a developer agitating member.
Figure 7:
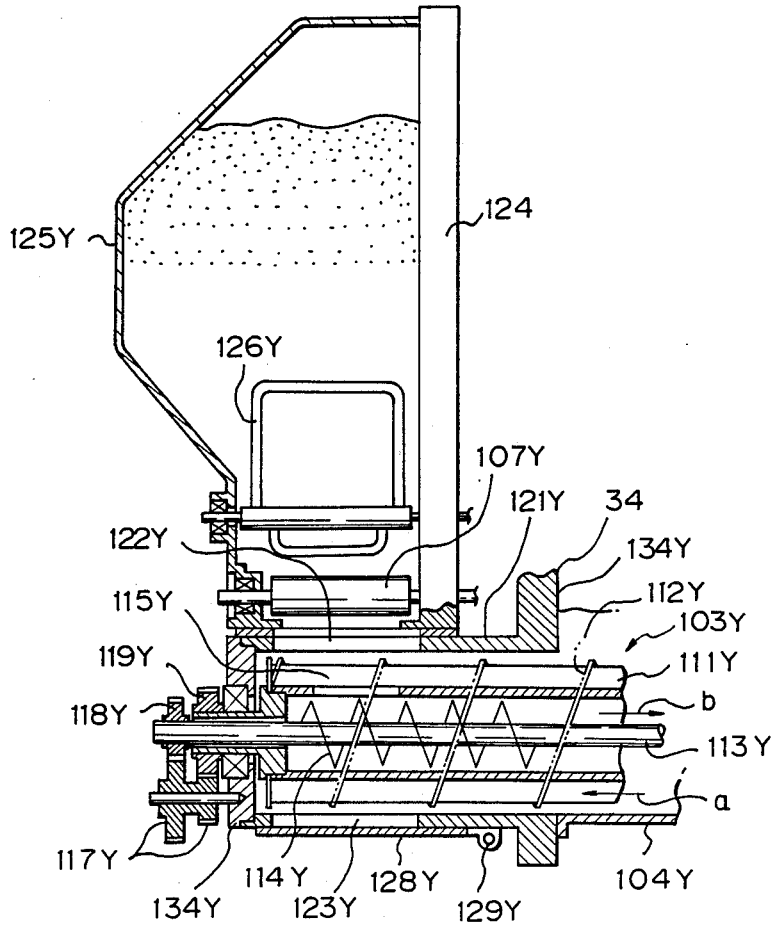
FIG. 7 is a section of a toner supply section.
Figure 8:
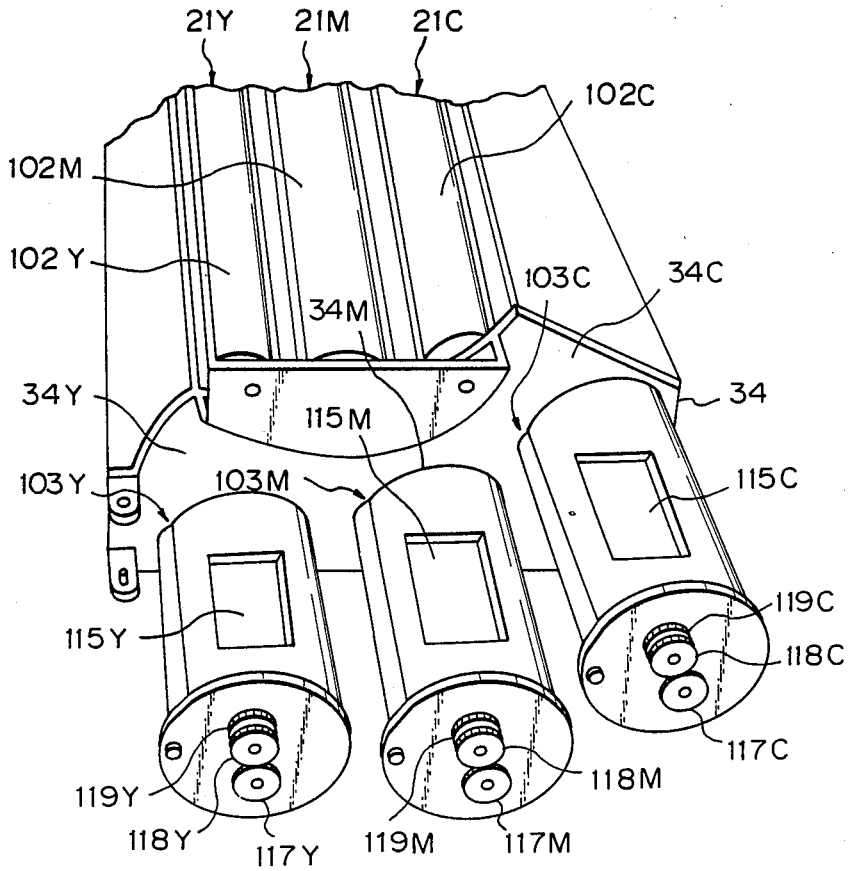
FIG. 8 is a perspective view of the color developing unit as viewed from the front side, with toner containers removed for clarity.

Referring to FIG. 6, the developer agitating member 103Y includes a paddle 111Y, an outer screw 112Y wound around the paddle 111Y, and the previously mentioned inner screw 114Y provided on the previously mentioned shaft 113Y, which is accommodated in the paddle 111Y. The paddle 111Y is formed with a developer inlet 115Y and a developer outlet 116Y which is located at the rear of the developer inlet 115Y. As shown in FIGS. 7 and 8, the inner screw 114Y is driven in a rotary motion via a gear 119Y which is held in mesh with a gear, not shown, mounted on the copier body 45 and gears 117Y and 118Y which are sequentially meshed with the gear 119Y. The paddle 111Y provided with the external outer screw 112Y is rotated via the previously mentioned gear 50Y, FIG. 3, which is disposed at the rear of the rear support member 33Y. As is clearly shown in FIG. 7, the rear side of the agitating member 103Y is rotatably supported by the rear support member 34 with or without the intermediary of a support piece 134Y which is mounted on the support member 34.

In FIG. 6, when the paddle 111Y and the shaft 113Y are rotated, the developer is transported by the outer screw 112Y of the paddle 111Y in a direction indicated by an arrow a i.e., toward the front end. During such transport, the developer enters the paddle 111Y via the developer inlet 115Y and is then conveyed by the inner screw 114Y as indicated by an arrow b, i.e., toward the rear end. The developer coming out through the developer outlet 116Y is again transported in the direction a. In this manner, the developer is circulated into and out of the paddle 111Y while being agitated together with supplementary toner which will be described. While the developer is transported in the direction a from the developer outlet 116Y, the paddle 111Y supplies it to the developing roller 102Y.

A front part of the agitating member 103Y as viewed in FIG. 2 protrudes from the developer casing 104Y, as shown in FIG. 7. That is, in FIG. 7, it protrudes to the left from the developer casing 104Y, which is rigidly connected to the front support member 34. Connected to this protruded portion is the end of the developer casing 104Y. The support member 34 is provided with a hollow tubular boss portion 121Y which surrounds the protruded portion of the agitating member 103Y, the support piece 134Y being fixed to the tip of the boss portion 121Y. As is shown in FIG. 9, the stationary support member 34 is provided with hollow tubular boss portions 121M and 121C which are respectively assigned to the magenta and cyan developing sections 21M and 21C in addition to the hollow tubular boss portion 121Y.

In FIGS. 7 and 8, a developer inlet 122Y and a developer outlet 123Y are respectively provided in an upper and a lower part of the hollow tubular boss portion 121Y. The developer inlet 122Y and the developer outlet 123Y are adapted for the replacement and the collection of developer, respectively. As is also shown in FIG. 9, a hopper-like toner container 125Y is provided integrally with a movable plate 124 and stores fresh yellow toner therein. A magenta toner container 125M and a cyan toner container 125C are constructed integrally with the yellow toner container 125Y, as shown in FIGS. 3 and 9. As is shown in FIG. 7, an agitator 126Y is disposed in the toner container 125Y and is oscillatable to prevent toner from bridging within the toner container 125Y.

Figure 9:
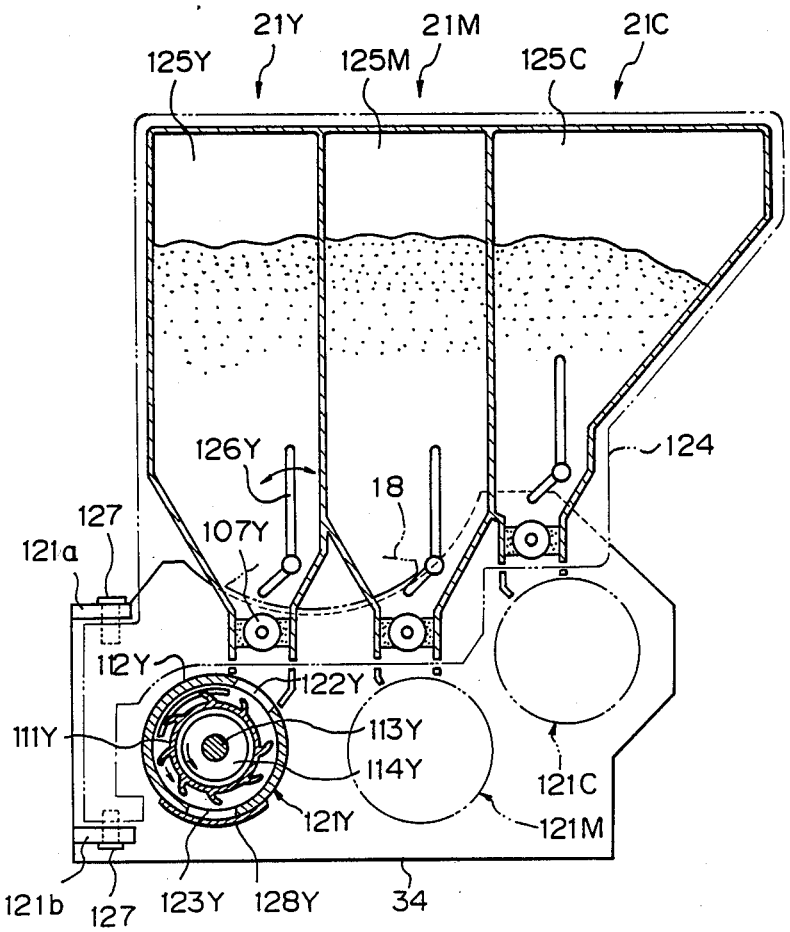
FIG. 9 is a partly simplified and partly omitted section of the toner containers and the neighborhood thereof.

When the toner sensor 105Y shown in FIG. 2 senses a decrease in toner density beyond a predetermined reference level, a toner supply roller 107Y located in a lower portion of the toner container 125Y as shown in FIGS. 7 and 9 is rotated to cause the fresh developer, or yellow toner, to drop from the container 125Y. Then the developer is introduced into the paddle 111Y via the developer inlet 115Y and there transported by the inner screw 114Y in the direction b while being agitated together with the developer which has been used. Fresh toner is supplied by such a procedure. Afterwards, the developer is circulated into and out of the paddle 111Y while being supplied to the developing roller 102Y, as stated earlier. In this case, the developer inlet 122Y plays the role of a toner supply port. The supply of fresh toner described above applies to each of the magenta and cyan developing sections also.

As shown in FIG. 9, the toner containers 125Y, 125M and 125C each constituting a toner supply section is mounted on the movable plate 124 as a unit. This kind of unitary developing device can be provided with a compact design, but the developer stored in the color developing section 21M interposed between the others 21Y and 21C cannot be replaced as easily as those stored in the sections 21Y and 21C. Although the color developing sections 21Y, 21M and 21C may be provided independently of each other to promote the ease of developer replacement, such a construction would increase the overall dimensions and cost of the device and, in some cases, would require developing sections which are individually detachable from a machine body. To solve this problem, as shown in FIG. 9, the movable plate 124 carrying the toner containers 125Y, 125M and 125C therewith is rotatably supported by hinge pins 127 which are each provided in a respective one of bent portions 121*a* of the support member 34 (see FIG. 3).

In a usual copying condition, the developer outlet 123Y which is provided at the bottom of the yellow toner container 125Y is held in alignment with the developer inlet 122Y. This is true for the other color developing sections 21M and 21C. To supply a fresh developer, the movable plate 124 is rotated about the hinge pins 127 toward the front as viewed in FIG. 9. This uncovers the developer inlet 122Y to allow a fresh developer to be supplied therethrough. While this operation is under way, the developer agitating member 103Y is continuously rotated. To cover and uncover the developer inlet 122Y as stated above, the toner container 125Y may be displaced by any other motion than rotation or may even be constructed to be removable.

As shown in FIGS. 7 and 9, the developer outlet 123Y is usually closed by a closure member 128Y. To collect the old developer, the closure member 128Y may be rotated about a hinge pin 129Y to uncover the developer outlet 123Y. In this condition, the agitating member 103Y is driven in a rotary motion so that the outer screw 112Y transports the old developer in the direction a and thereby discharges it via the developer outlet 123Y. In this instance, the movable plate 124 may be held in its original position, which is adapted for toner supply. Such a principle of developer replacement applies to the other developing sections 21M and 21C also. When the toner container 125Y is rotated as stated above, the toner supply roller 107Y serves to seal the bottom of the toner container 125Y.

As described above, this particular embodiment allows a developer to be replaced without the need for removing the developing unit itself from the machine body, remarkably enhancing efficient manipulation for the replacement. The developer inlet 122Y functions as a toner supply port in a usual copying condition and as an inlet port for a fresh developer in the event of replacement, simplifying the construction and reducing the cost of the device compared to a case wherein they are implemented by separate ports. While the supply of toner to the developer casing 104B of the black developing unit 21B is effected though the toner supply section 55 (FIG. 4) as previously stated, it may also be implemented with the construction of FIGS. 6 and 7. The construction and operation of the agitating member 103B of the black developing unit 21B are exactly the same as those shown in FIG. 6.

While the present invention has been shown and described mainly in relation to a color copier which produces a full-color image, it is similarly applicable to a monocolor image forming apparatus which develops a latent image provided on an image carrier in any one of different colors to produce an image of desired a single color or of multiple colors (e.g. black, blue, red and green). Further, the present invention is applicable even to an image forming apparatus in which a plurality of developing units store a developer of identical color so that the units other than the unit being used may serve as spare units. The color copier shown in the figures may be constructed such that a full-color or a black-and-white copy is produced as desired through selecting means such as a selection key or such that one of the developing units selected by a selecting means is operated to produce an image in yellow, magenta, cyan or a combination thereof or an image in a plurality of different colors. In this manner, the present invention is further applicable to an image forming apparatus having a monocolor and a full-color imaging capability.

The present invention is of course practicible not only with a two-component developer described above but also with a one-component developer which does not contain carrier or even with a developing device in which one developing unit uses one-component developer and another developing unit uses a two-component developer. Since a color and a black developing unit is separate from each other, a construction wherein the former uses one-component developer and the latter uses a two-component developer or vice versa can be implemented with ease. This is true with a developing device of any image forming apparatus other than a copier. When use is made of a non-magnetic developer, the magnet in each of the developing rollers is omissible, and the developing rollers may be replaced with belts or like developer transport members, as is well known in the art.

In summary, it will be seen that the present invention provides a developing device which is simple and inexpensive due to the decrease in the number of structural elements. In addition, the device of the present invention promotes ease of maintenance of a black developing unit which is used more frequently than the others.

Various modifications will become possible for those skilled in the art after receiving the teachings of the present disclosure without departing from the scope thereof.

What is claimed is:

1. An image forming apparatus comprising:

(a) an image carrier;

(b) first developing means comprising a plurality of developing sections which are arranged around said image carrier, at least two of said developing sections being constructed into a single unit;

(c) second developing means comprising a single developing section disposed around said image carrier;

(d) third means for moving said first developing means back and forth between an operative position in which said at least two of said developing sections are both in operative association with said image carrier and an inoperative position in which neither of said at least two of said developing sections is in operative association with said image carrier; and (e) fourth means for moving said second developing means back and forth between an operative position in which said single developing section is in operative association with said image carrier and an inoperative position in which said single developing section is not in operative association with said image carrier, wherein said unit of said first developing means and said unit of said second developing means are constructed and arranged independently of each other.

2. An image forming apparatus as claimed in claim 1, wherein:

(a) said plurality of developing sections of said first developing means comprise color developing sections and (b) said single developing section of said second developing means comprises a black developing unit.

3. An image forming apparatus as claimed in claim 1 wherein:

(a) each one of said developing sections in said first developing means comprises a hollow tubular portion;

(b) each one of said hollow tubular portions has a developing inlet in its upper part; and (c) each one of said hollow tubular portions has a developing outlet in its lower part.

4. An image forming apparatus as claimed in claim 1 wherein:

(a) said image forming apparatus further comprises a movable plate and (b) each one of said developing sections in said first developing means comprises a hopper-like toner container provided integrally with said movable plate.

5. An image forming apparatus as claimed in claim 1 and further comprising:

(a) a copier body and (b) means on said copier body and on each one of said developing sections for individually locating each one of said developing sections at a predetermined position relative to said image carrier.

6. An image forming apparatus as claimed in claim 5 wherein said means comprise:

(a) a positioning pin mounted on each one of said developing sections and (b) a mating hole formed in said copier body.

7. An image forming apparatus as claimed in claim 1 and further comprising a cover which protects said developing sections of said first developing means and functions as an air guide member.

8. An image forming apparatus as claimed in claim 7, wherein:

(a) said cover contains a vent and (b) a flow regulator plate is provided inside said cover downstream of said vent.

9. An image forming apparatus as claimed in claim 1, wherein said plurality of developing sections of said first developing means each comprises:

(a) a developer casing in which a developer is stored and (b) a developer carrier which supplies developer to said image carrier.

10. An image forming apparatus as claimed in claim 9, wherein said developer casing comprises:

(a) a body and (b) end walls each of which is provided on a respective one of opposite ends of said body.

11. An image forming apparatus as claimed in claim 10, wherein said end walls of at least two of said developing sections of said first developing means are constituted by common support members.

12. An image forming apparatus as claimed in claim 11, wherein said common support members are individually fixed to said body.

13. An image forming apparatus claimed in claim 11 wherein:

(a) said end walls of at least two of said developing sections of said first developing means are provided with hollow tubular boss portions;

(b) said image forming apparatus further comprises agitating members having protruded portions; and (c) each one of said hollow tubular boss portions surrounds a corresponding one of said protruded portions.

14. An image forming apparatus as claimed in claim 10, wherein said developer casing further comprises a rib for connecting said body to an adjacent body.

15. An image forming apparatus as claimed in claim 14, wherein said rib contains an opening for passing air therethrough.

* * * * *

UNITED STATES PATENT AND TRADEMARK OFFICE

CERTIFICATE OF CORRECTION

PATENT NO. : 4,928,144

DATED : MAY 22, 1990

INVENTOR(S) : NOBUO KASAHARA ET AL.

It is certified that error appears in the above-identified patent and that said Letters Patent is hereby corrected as shown below:

On the title page, the assignee is missing. Please insert --Ricoh Company, Ltd., Tokyo, JAPAN--.

On the title page, the firms name is missing. Please insert --Attorney, Firm, or Agent -- Oblon, Spivak, McClelland, Maier & Neustadt--.

Signed and Sealed this

Seventeenth Day of September, 1991

*Attest:*

HARRY F. MANBECK, JR.

*Attesting Officer*

*Commissioner of Patents and Trademarks*